US009982966B2

(12) United States Patent
Porat

(10) Patent No.: US 9,982,966 B2
(45) Date of Patent: May 29, 2018

(54) ACCESSORY FOR CONCEALED WEAPON CARRY

(71) Applicant: Recover Innovations Ltd., Holon (IL)

(72) Inventor: Tamir Porat, Tel Aviv (IL)

(73) Assignee: Recover Innovations Ltd., Holon (IL)

( * ) Notice: Subject to any disclaimer, the term of this patent is extended or adjusted under 35 U.S.C. 154(b) by 0 days. days.

(21) Appl. No.: 15/386,124

(22) Filed: Dec. 21, 2016

(65) Prior Publication Data

US 2017/0184376 A1 Jun. 29, 2017

Related U.S. Application Data

(60) Provisional application No. 62/272,159, filed on Dec. 29, 2015.

(51) Int. Cl.
*F41G 11/00* (2006.01)
*F41C 33/00* (2006.01)
*F41C 3/00* (2006.01)

(52) U.S. Cl.
CPC ..... *F41G 11/003* (2013.01); *F41C 33/008* (2013.01); *F41C 3/00* (2013.01)

(58) Field of Classification Search
CPC ..... F41C 33/006; F41C 33/04; F41C 33/041; F41C 33/048; F41C 33/0236; F41C 33/0245; F41C 33/0254; F41C 23/10; F41C 27/00; F41A 35/00
USPC ..... 42/85, 90, 106
See application file for complete search history.

(56) References Cited

U.S. PATENT DOCUMENTS 4,383,371 A * 5/1983 Coffey ..... F41G 11/003 42/124
5,107,612 A * 4/1992 Bechtel ..... F41G 11/003 42/115
D328,632 S * 8/1992 Bigwood ..... 89/14.3
5,166,459 A * 11/1992 Stahle ..... F41G 1/35 42/111
5,630,535 A * 5/1997 Valenti ..... A45F 5/02 224/191
5,749,507 A * 5/1998 Wood ..... F41A 23/18 224/255
5,810,221 A * 9/1998 Beletsky ..... F41C 33/0227 224/244
5,881,938 A * 3/1999 Wakefield ..... F41C 33/008 224/192
6,267,279 B1 * 7/2001 Matthews ..... F41C 33/0236 224/191
6,393,752 B1 * 5/2002 Oliver ..... F41G 1/35 362/110
6,547,415 B1 * 4/2003 Matthews ..... B62J 6/00 24/11 P
6,637,144 B2 * 10/2003 Nelson ..... F41G 11/003 42/120
6,705,038 B2 * 3/2004 Davenport ..... F41G 11/004 42/127
6,726,072 B2 * 4/2004 Rugh ..... A45F 5/02 224/269
7,194,836 B1 * 3/2007 Urban ..... F41C 27/22 42/106

(Continued)

*Primary Examiner* — Derrick R Morgan
(74) *Attorney, Agent, or Firm* — Dekel Patent Ltd.; David Klein

(57) ABSTRACT

A weapon accessory includes a tactical rail attachment attachable to a firearm and a concealed weapon clip attached to the tactical rail attachment.

3 Claims, 2 Drawing Sheets

(56) References Cited

U.S. PATENT DOCUMENTS 7,334,365 B2 * 2/2008 Kim ..... F41G 11/003 42/124
D607,079 S * 12/2009 Moody ..... D22/109
D685,051 S * 6/2013 Melville ..... D22/108
9,086,254 B1 * 7/2015 Plappert ..... F41C 33/041
9,261,328 B2 * 2/2016 Sitz ..... F41A 23/18
9,291,413 B1 * 3/2016 Viani ..... F41C 27/00
D757,198 S * 5/2016 McDole ..... D22/108
9,470,480 B2 * 10/2016 Kirchhoff ..... F41G 11/001
9,777,983 B2 * 10/2017 Porat ..... F41C 23/10
2005/0184115 A1 * 8/2005 Wells ..... A45F 5/02 224/193
2005/0268518 A1 * 12/2005 Pikielny ..... F41C 33/0209 42/90
2005/0279004 A1 * 12/2005 Woodmansee, III ..... F41G 1/00 42/146
2008/0060247 A1 * 3/2008 Thomele ..... F41A 3/66 42/71.02
2008/0148619 A1 * 6/2008 Rogers ..... F41G 11/003 42/90
2009/0064558 A1 * 3/2009 Woroner ..... F41G 11/003 42/90
2009/0293334 A1 * 12/2009 Swan ..... F41C 33/007 42/90
2010/0263254 A1 * 10/2010 Glock ..... F41A 11/02 42/71.02
2010/0263255 A1 * 10/2010 Harris ..... F41C 27/00 42/90
2011/0167704 A1 * 7/2011 Chupp ..... F41G 11/003 42/90
2012/0030986 A1 * 2/2012 Swan ..... F41C 23/02 42/85
2012/0317854 A1 * 12/2012 Nierenberg ..... F41C 23/06 42/1.06
2013/0327798 A1 * 12/2013 Lee ..... F41C 33/008 224/183
2013/0327799 A1 * 12/2013 Sitz ..... F41C 33/0245 224/243
2014/0068991 A1 * 3/2014 Jung ..... F41G 11/003 42/90
2014/0109345 A1 * 4/2014 Melville ..... F41G 11/003 24/3.1
2014/0245648 A1 * 9/2014 Nierenberg ..... F41C 23/08 42/1.06
2015/0192391 A1 * 7/2015 Moore ..... F41G 1/35 42/117
2016/0003577 A1 * 1/2016 Bowers ..... F41C 23/12 42/90
2016/0040957 A1 * 2/2016 Finsand ..... F41C 33/008 224/269
2016/0146573 A1 * 5/2016 Kunkel ..... F41G 11/003 42/90
2016/0176226 A1 * 6/2016 Chatterton ..... A45C 11/18 24/67.11
2016/0265876 A1 * 9/2016 Young ..... F41C 33/0245
2016/0282082 A1 * 9/2016 Porat ..... F41C 23/10

* cited by examiner

ACCESSORY FOR CONCEALED WEAPON CARRY

FIELD OF THE INVENTION

The present invention relates generally to accessories for handguns, and particularly to an accessory for a handgun that includes a concealed weapon clip and a tactical rail attachment.

BACKGROUND OF THE INVENTION

Concealed weapon clips for attachment to a handgun are known. These clips enable the handgun to be carried near the user's waist, with the clip engaging the user's belt.

For example, the CLIPDRAW, available from Skyline Toolworks LLC, of Malvern, Pa., provides a belt clip for carrying a handgun. The one-piece clip is screwed directly onto the handgun or affixed in place with an adhesive, such as tape or glue, when it is desired to clip the gun to a belt, or removed therefrom when it is desired to carry the handgun in a holster.

A major problem with the CLIPDRAW product described above is its inflexibility. To use the product, one must use existing screw holes or drill and tap new screw holes, or use adhesives which mar the finish of the firearm. Once attached, the CLIPDRAW product cannot be repositioned without drilling and tapping new holes or reapplying adhesives. Thus, it is inconvenient to move the clip to a different position or to a different handgun.

SUMMARY OF THE INVENTION

The present invention seeks to provide an accessory for a handgun that includes a concealed weapon clip and a tactical rail attachment, as is described more in detail hereinbelow. Instead of attaching the concealed weapon clip directly to the handgun (which could require drilling and tapping holes in the handgun), in the present invention, no rework of the handgun is required at all. In the present invention, the tactical rail is attached to the handgun and the concealed weapon clip is attached to the tactical rail.

There is provided in accordance with an embodiment of the invention a weapon accessory including a tactical rail attachment attachable to a firearm and a concealed weapon clip attached to the tactical rail attachment.

In accordance with an embodiment of the invention the tactical rail attachment includes an abutment for abutting against a trigger guard of the firearm.

In accordance with an embodiment of the invention the concealed weapon clip includes a tongue that points in a shooting direction of the firearm.

In accordance with an embodiment of the invention the concealed weapon clip is attached to the tactical rail attachment with fasteners.

In accordance with an embodiment of the invention the concealed weapon clip is attached to a recess formed in the tactical rail attachment.

In accordance with an embodiment of the invention the tactical rail attachment includes an end face for abutting against a muzzle of the firearm.

In accordance with an embodiment of the invention the tactical rail attachment includes left and right halves fastened to one another.

In accordance with an embodiment of the invention the concealed weapon clip includes a lip with mounting holes formed therein, a first plate extending transverse from the lip, a second plate extending transverse from the first plate, and an elongate U-shaped clip extending transverse from the second plate.

There is also provided in accordance with an embodiment of the invention a weapon including a barrel, a receiver frame, a trigger and a grip, a tactical rail attachment attached to the receiver frame, and a concealed weapon clip attached to the tactical rail attachment.

BRIEF DESCRIPTION OF THE DRAWINGS

The present invention will be understood and appreciated more fully from the following detailed description taken in conjunction with the drawings in which.

DETAILED DESCRIPTION OF EMBODIMENTS

Figure 1:
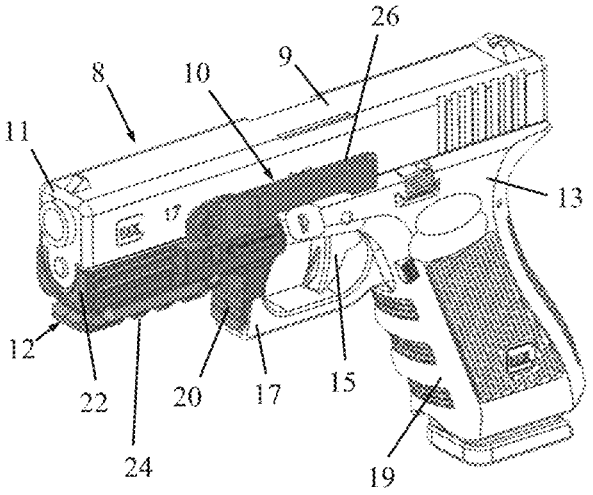
FIG. 1 is a simplified pictorial illustration of a weapon with a concealed weapon clip and a tactical rail attachment attached thereto, constructed and operative in accordance with an embodiment of the present invention.

Reference is now made to FIG. 1, which illustrates a weapon (firearm) 8 with a concealed weapon clip 10 and a tactical rail attachment 12 attached thereto, constructed and operative in accordance with a non-limiting embodiment of the present invention. The concealed weapon clip 10 and a tactical rail attachment 12 together form a weapon accessory. Without limitation, the accessory is made for a handgun, such as those manufactured by SPRINGFIELD, GLOCK, COLT, RUGER, SIG SAUER or other handgun. The weapon accessory may be made of a polymer, metal, elastomer or any other suitable material.

As is well known in the art, firearm 8 includes, without limitation, a slide 9, a muzzle 11, a receiver frame 13, a trigger 15, a trigger guard 17 and a grip 19.

Figure 2A:
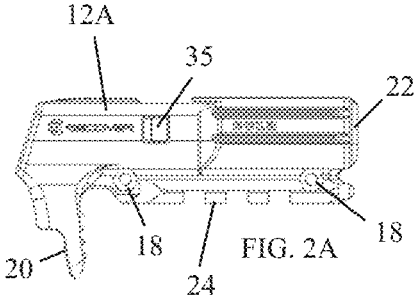
FIGS. 2A and 2B are simplified pictorial illustrations of left and right portions of the tactical rail attachment, in accordance with an embodiment of the present invention.
Figure 2B:
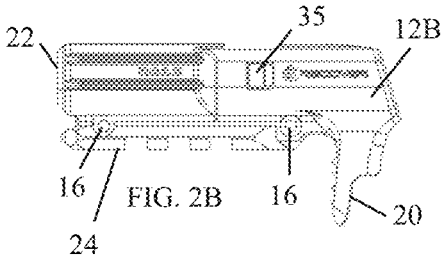

As seen in FIGS. 2A and 2B, tactical rail attachment 12 may include right and left halves 12A and 12B, which may be fastened to one another, such as by screws 16 and nuts 18. Tactical rail attachment 12 may include an abutment 20 for abutting against trigger guard 17 and an end face 22 for abutting against muzzle 11. When the screws and nuts are tightened, the tactical rail attachment 12 is securely fastened to the firearm 8.

Figure 4A:
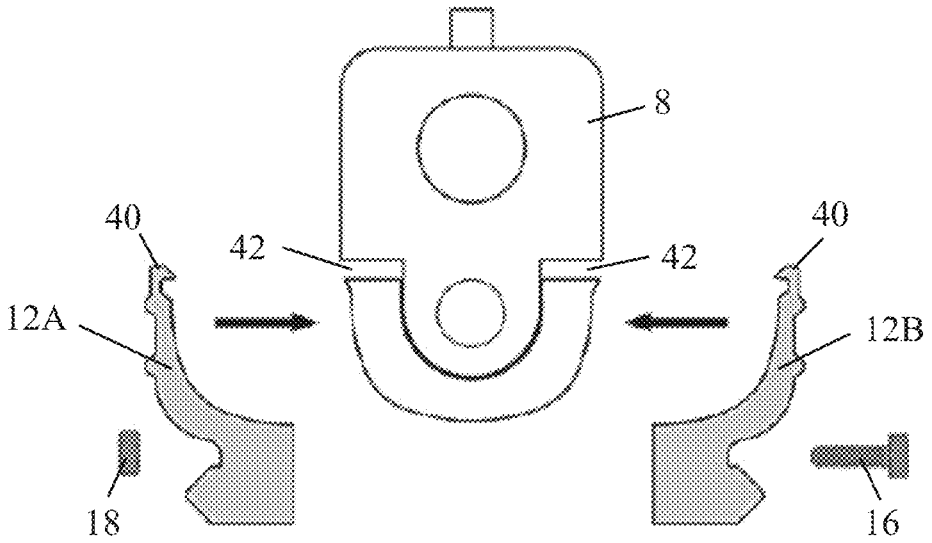
FIGS. 4A and 4B are simplified end-view illustrations of the weapon with the concealed weapon clip and tactical rail attachment attached thereto, respectively before and after assembly of the clip and rail attachment on the weapon.
Figure 4B:
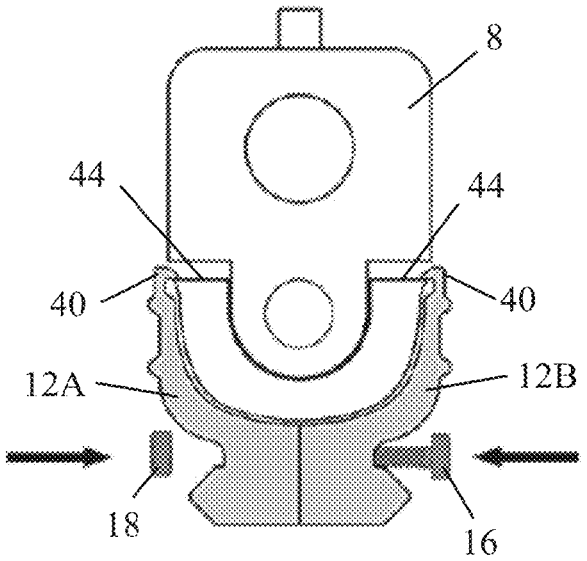

Referring to FIGS. 4A and 4B, the right and left halves 12A and 12B may each include an upper longitudinal claw 40 that fits into a longitudinal groove 42 formed on each side of weapon 8. The bottom surfaces of claw 40 rests over a shelf surface 44 defined in longitudinal groove 42. This structure ensures the right and left halves 12A and 12B positively seat against the weapon 8.

Tactical rail attachment 12 includes an accessories rail 24 on a lower face thereof. The accessories rail 24 may be, without limitation, a Picatinny rail or Weaver rail. It is noted that the term "light rail" (or a "Picatinny rail", or "universal rail", or "tactical rail", or "accessories rail", the terms being used interchangeably throughout the specification and claims) as used in the description and the claims, encompasses any kind of mounting rail for accessories, such as but not limited to, white lights, infrared and laser illuminating devices and telescopic sights, for example.

Figure 3:
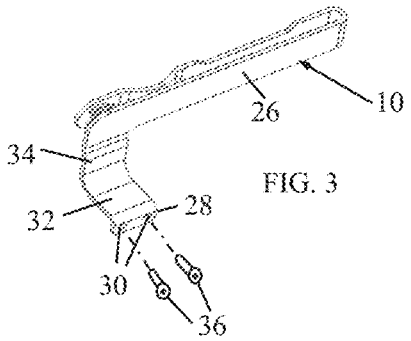
FIG. 3 is a simplified pictorial illustration of the concealed weapon clip, in accordance with an embodiment of the present invention.

In accordance with an embodiment of the invention the concealed weapon clip 10 includes a tongue 26 that points in a shooting direction of the firearm 8. In the illustrated embodiment shown in FIG. 3, concealed weapon clip 10 includes a lip 28 with mounting holes 30 formed therein, a first plate 32 extending transverse from lip 28, a second plate 34 extending transverse from first plate 32, and an elongate U-shaped clip (tongue) 26 extending transverse from second plate 34.

In accordance with an embodiment of the invention, concealed weapon clip 10 is attached to a recess 35 formed in the tactical rail attachment 12 with fasteners 36.

What is claimed is:

1. A weapon comprising:

a barrel, a slide, a muzzle, a receiver frame, a trigger, a trigger guard, and a grip;

a tactical rail attachment attached to said receiver frame; and a concealed weapon clip attached to said tactical rail attachment;

wherein said tactical rail attachment comprises right and left halves fastened to one another with first fasteners, said tactical rail attachment comprising an abutment that abuts against said trigger guard and an end face that abuts against said muzzle, wherein said abutment has a first portion that abuts against a face of said trigger guard that faces towards a shooting direction of the weapon and a second portion that comprises left and right side extensions that face perpendicular to the shooting direction;

wherein said concealed weapon clip is attached to said tactical rail attachment with second fasteners; and wherein said concealed weapon clip is attached to a recess formed in said tactical rail attachment.

2. The weapon according to claim 1, wherein a surface of said first portion that faces towards the shooting direction of the weapon is formed with ridges.

3. The weapon according to claim 1, wherein said concealed weapon clip comprises a tongue that points in a shooting direction of the weapon.

* * * * *